United States Patent [19]

Boisvert

[11] Patent Number: 4,984,305

[45] Date of Patent: Jan. 15, 1991

[54] SELF VENTILATING TOILET

[76] Inventor: Paul J. Boisvert, 6170, Primeau Laval Québec H0A 1G0, Canada

[21] Appl. No.: 454,925

[22] Filed: Dec. 22, 1989

[51] Int. Cl.[5] ..... E03D 9/04; E03D 13/00

[52] U.S. Cl. ..... 4/213; 4/209; 4/216

[58] Field of Search ..... 4/213, 209, 216, 218

[56] References Cited

U.S. PATENT DOCUMENTS

| | | | |
|---|---|---|---|
| 2,041,962 | 5/1936 | Robertson | 4/213 |
| 2,058,436 | 10/1936 | Friel | 4/213 |
| 2,451,108 | 10/1948 | Molpus | 4/213 |
| 2,619,655 | 12/1952 | Huff | 4/213 |
| 2,985,890 | 5/1961 | Baither | 4/213 |
| 3,120,006 | 2/1964 | Knoppe | 4/213 |
| 3,335,431 | 8/1967 | Coates | 4/213 |
| 3,805,304 | 4/1974 | Ikehata | 4/213 X |
| 4,222,129 | 9/1980 | Baker | 4/213 |

*Primary Examiner*—Henry K. Artis

*Attorney, Agent, or Firm*—Roland L. Morneau

[57] ABSTRACT

A ventilated toilet having a water discharge passage is mounted over a sewage connecting line. The latter line is also connected to a ventilating chamber for receiving air from the bowl chamber through an electrical suction device. The electrical cord supplying the suction device extends through a self-contained passage adjacent the ventilating chamber for isolating the cord from the ventilating chamber.

4 Claims, 4 Drawing Sheets

SELF VENTILATING TOILET

FIELD OF THE INVENTION

This invention relates to improvements in toilets and more particularly to a self ventilating toilet adapted to remove the fumes and odors from the bowl and discharge the same into the waste pipe.

BACKGROUND OF THE INVENTION:

Various forms of structures have been heretofore provided for venting objectionable odors from within toilet bowls.

However, some of these structures cannot meet the minimal safety electrical standards required in bathrooms for certain regions.

Canadian Patent 3,120,006 and U.S. Pat. No. 1,972,774 are patents disclosing toilet bowl ventilating systems which could prove to be potentially dangerous because an electrical wire is exposed and connected by a wall plug.

Indeed, since the extension chord supplying power to the ventilation units is not fully enclosed and is therefore exposed to the humid environment of the bathrooms, previously cited structures cannot be considered safe for people using them.

Furthermore, some of the above-mentioned patents disclose structures which require costly installation procedures.

Canadian Patent 1,012,304 in an example of a patent disclosing a structure which would require setting up of a duct system in the wall of the bathroom.

SUMMARY OF THE INVENTION

The invention relates to a self ventilated toilet which is adapted to be mounted on the floor of a bathroom. The floor must be provided with a first perforation connected to a sewage connecting line and a second perforation allowing an electrically conducting wire to extend through the floor.

The ventilated toilet features a bowl chamber adapted to contain water which will be flushed through a flushing aperture which is provided at the bottom of the bowl. A discharge passage is connected to the flushing aperture.

The discharged passage is disposed adjacent the bowl chamber and extends to a first outlet situated below the bowl for eliminating the flushed water through the first perforation.

A ventilating chamber is mounted adjacent the discharge passage and leads through the first outlet. A least one ventilating inlet aperture is provided in the bowl and located above the water in the bowl.

The ventilating inlet apertures pneumatically link the bowl with the ventilating chamber. An electrical air suction device isdisposed across the ventilating chamber between the ventilating aperture and the first outlet for circulating the air from the ventilating aperture through the first outlet.

A conduit adapted to receive the electrical wire is also provided. The electrical wire is adapted to electrically actuate the suction device. The conduit is located adjacent the ventilating chamber and extends upwardly between the suction device and a second outlet which is positioned below the bowl.

The second outlet is adapted to face the second perforation provided in the floor. The electrical wire is therefore adapted to extend through the floor below the bowl and the suction device is adapted to expel the air through the sewage connecting line.

In one embodiment of the invention, the electrical suction device comprises an electrical fan and a set of guiding fins which extend from the fan in the direction of the first aperture whereby the guiding fins limit the air turbulence inside the ventilating chamber and promote air circulation toward the first aperture.

In another embodiment of the invention, the suction device comprises a hinged flap which prevents the air from circulating from the first outlet to the ventilating aperture thus backing up into the bowl chamber. In an alternative embodiment of the invention the suction device comprises an electro-magnetic valve for operating the flap. The hinged flap can be kept in a normally closed position by a counterweight and is opened by the flow of air emanating from the fan. The fan can be either of an axial or a centrifugial type.

The ventilating chamber has a generally upstanding peripheral wall. The conduit for receiving the electrical wire is characterized by a channel extending substantially vertically in the body of the peripheral wall.

The ventilating chamber is preferably provided with a removable cover allowing access to the suction device.

Accordingly, the present invention relates to an improved self ventilating toilet which will draw the fumes and odors from within the bowl and discharge the same through the drain pipe.

Another object of this invention is to provide a self ventilating toilet whereby, the electrical chord supplying power to the ventilation unit is fully enclosed and therefore protected against the humid environment often present in bathrooms, thus making the self ventilating toilet safe against electrical shocks.

A still further object of this invention is to provide a self ventilating toilet which can be readily and easily installed at low cost and which uses the same drain pipe arrangement as a conventional toilet, thus allowing for easy replacement of a conventional toilet by the present self ventilating toilet.

Another object of this invention is to provide a ventilating system for toilet bowls which is so arranged and incorporated in the toilet bowl structure as to be fully enclosed therein without unduly altering the symetrical and more or less conventional exterior appearance of the toilet bowl structure so that a neat and compact appearance is maintained.

A still further object of this invention is to provide a self ventilating toilet which will conform to conventional manufacturing methods, be of simple construction and easy to use, economical, long lasting and relatively trouble free in operation.

DESCRIPTION OF THE PREFERRED EMBODIMENT

Figure 1:
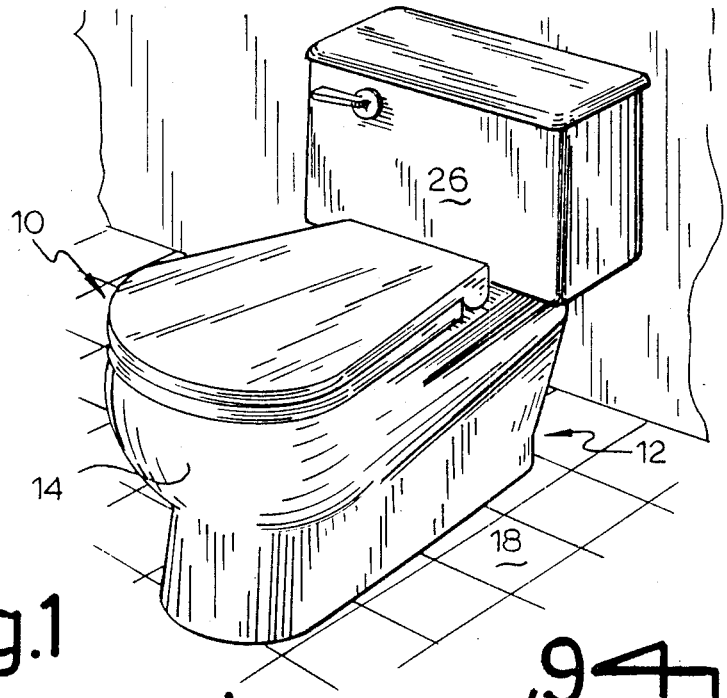
FIG. 1 is a perspective view of the ventilated toilet bowl.

The ventilated toilet 10 has a body 12 which is cast as an integral structure, and is shaped interiorly to provide an upwardly open bowl chamber 14 having a flushing aperture 13 leading to a siphonic discharge passage 16. The body 12 is adapted to rest on the floor 18 of a bathroom. The discharge passage 16 is hydraulically connected to a sewage collecting line 20 through an outlet 17 provided in the bottom of the body 12. The collecting line 20 opens upwardly through the floor 18. A pivoted seat 22 and a pivoted seat lid 24 are both hinged to the body 12.

In addition, a conventional water tank 26 is operatively associated with the bowl chamber 14 in a conventional manner for discharging flushing water into the bowl chamber 14.

The flushing water leaves the tank 26 through an opening 28 and enters a water intake chamber 30. The chamber 30 communicates hydraulically with an annular water passage 32 extending around the upper marginal portion of the bowl chamber 14. The annular water passage 32 leads to a flushing conduit 34 which delivers flushing water to the bowl 14 through an opening 36 provided at its base. A set of discharge opening 35 provided inside the annular passage 32 serves to discharge cleansing water over an interior surface 33 of the bowl chamber 14.

The bowl tapers down at the back to form a housing 38 enclosing the discharge passage 16 and a ventilating system 40. The ventilating system 40 includes an air chamber 42, a blower assembly 44, an air duct 46 and an electrical extension cord conduit 48.

The housing 38 is provided with a removable cover 39 allowing access to the blower assembly 44 for installation and repairs. The cover 39 is safely held in place by the tank 26 which partially rests on it and which must be removed prior to the removal of the cover 39.

Figure 2:
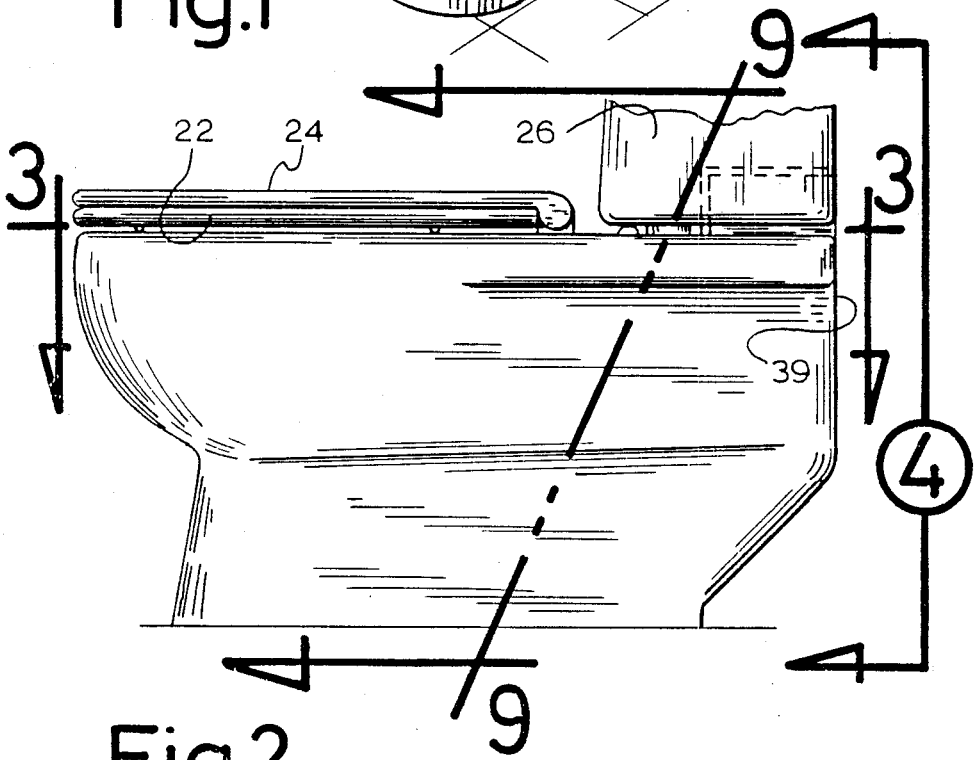
FIG. 2 is a side view of the bowl shown in FIG. 1.
Figure 3:
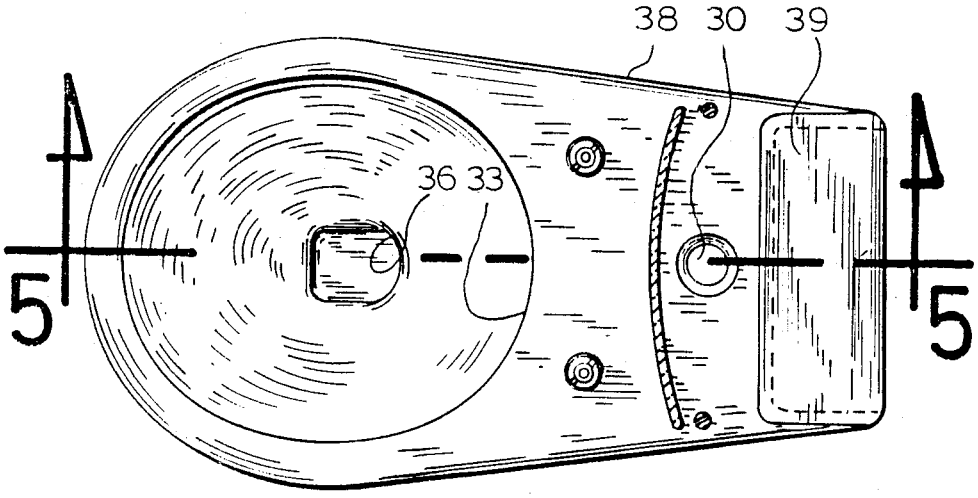
FIG. 3 is a horizontal cross-sectional view taken along line 3—3 of FIG. 2.
Figure 4:
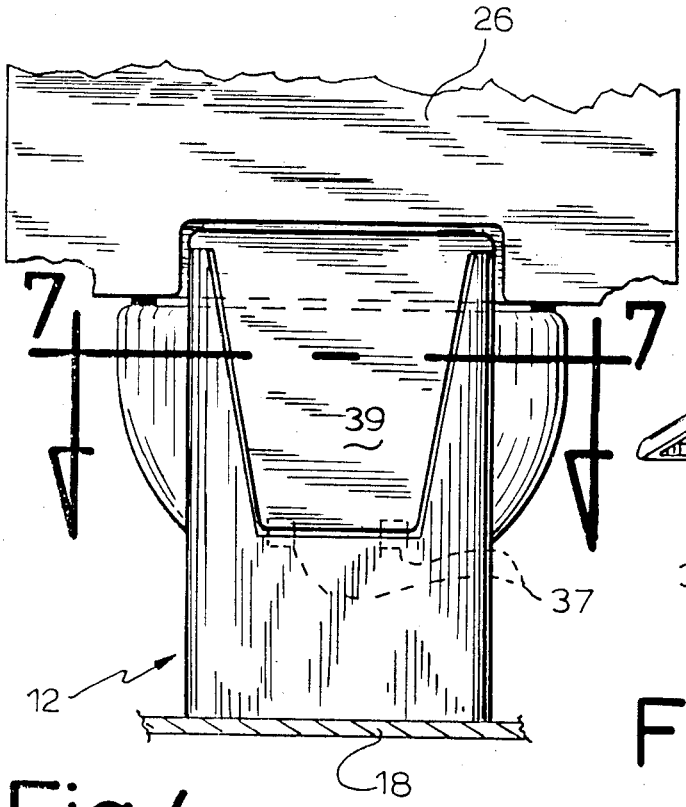
FIG. 4 is a vertical cross-sectional view taken along line 4—4 of FIG. 2.
Figure 8:
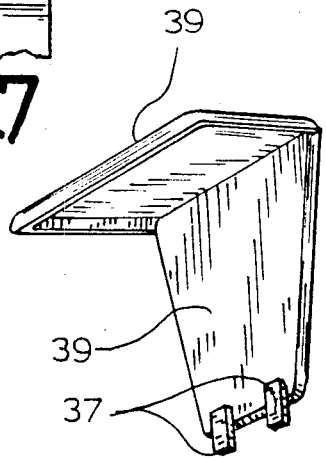
FIG. 8 is a perspective view of a cover located at the upper rear end of the bowl.

The cover per se 39 is illustrated in FIG. 8 and is shown in its installed position in FIGS. 2, 3 and 4. It is retained to the bowl by a pair of tongues 37 located at the lower end of the cover and by its horizontal portion which hooks onto the bowl.

The fumes emanating from the bowl chamber 14 are drawn into the air chamber 42 by the blower assembly 44 along the arrows A through an air inlet aperture 50 provided through the back of the interior wall 33 above the discharge passage 16.

Figure 5:
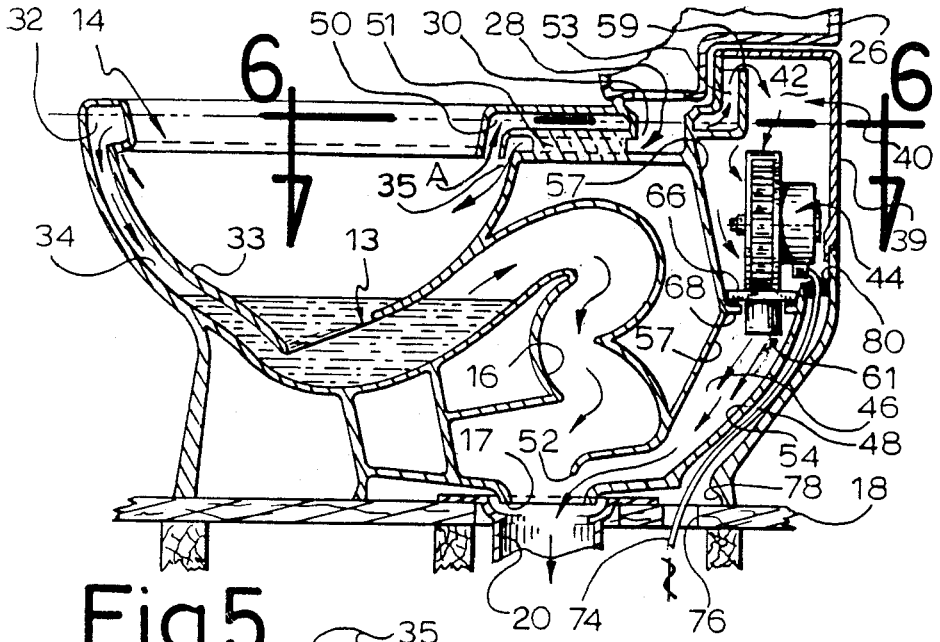
FIG. 5 is a cross-sectional view taken along line 5—5 of FIG. 3.
Figure 6:
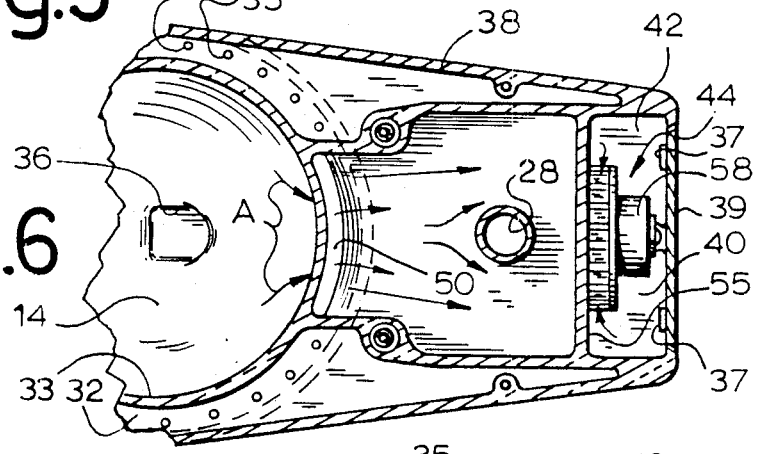
FIG. 6 is a horizontal cross-sectional view taken along line 6—6 of FIG. 5.
Figure 7:
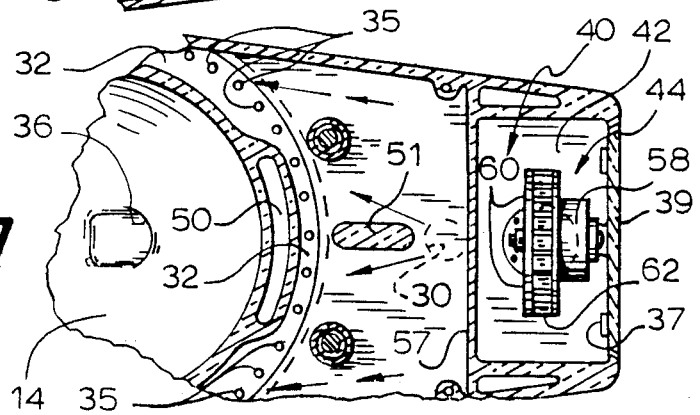
FIG. 7 is a horizontal cross-sectional view taken along line 7—7 of FIG. 4.
Figure 9:
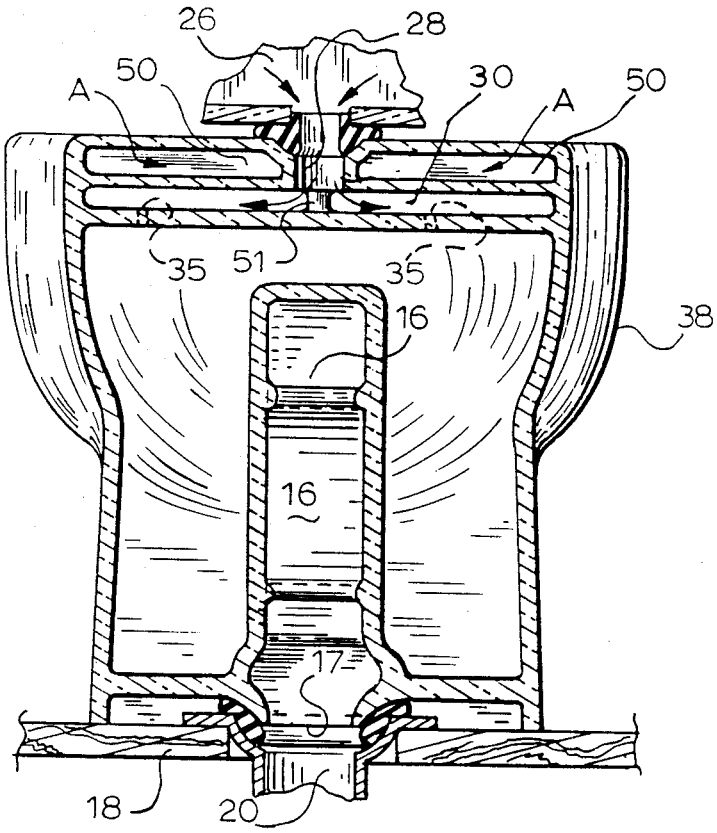
FIG. 9 is a cross-sectional view taken along line 9—9 of FIG. 2.

The fumes move rearwardly from the aperture 50 in the direction of arrow A (in FIG. 5), towards each side of the water intake chamber 30 and progresses upwardly in the channel 53 defined by walls 55 and 57. The path followed by the water comes out of the water intake chamber at a level lower than horizontal part of the inlet aperture 50. It is split by the partition wall 51 and progresses toward the lateral passages 32. The entrance of the inlet aperture 50 is substantially vertical to prevent solid matters to enter the aperture 50. The air inlet is superposed over the opening 28 of the outer chamber 30 (see FIG. 9).

This particular arrangement of the air passage from the bowl 14 to the air chamber 42 prevents an overflow of water in the bowl from reaching the air chamber. The channel 53 opens up at a level higher than the maximum level of the water in the bowl 14. This is particularly due to the upper leading edge 59 of the wall 57 which can be set at a higher level than the upper edge of the bowl.

The blower assembly 44 subsequently forces the fumes through the air duct 46 towards an air outlet 52 which discharges into the sewage collecting line 20. The air duct 46 is defined by a back wall 54 a front wall 57 corresponding to a wall of the discharge passage 16 and a pair of side walls (not shown).

Figure 10:
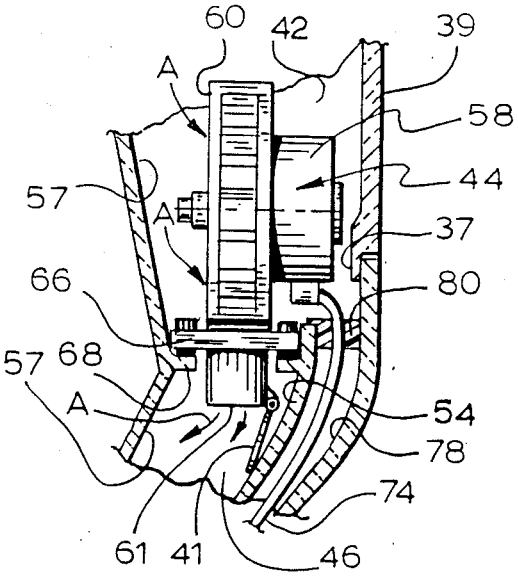
FIG. 10 is an enlarged view of the installation of the fan shown in FIG. 5.

The blower assembly 44, as particularly shown in FIG. 10 includes an electrical rotary motor 58 coupled to a centrifugal fan 60 linked to an air guiding case 61. An electro-magnetic valve 41 is mounted at the exit of the case 61. The electro-magnetic valve is provided to prevent the fumes from backing up into the bowl 14 when the blower assembly 44 is not in use.

The fan 60 is provided with a lateral rim 66 allowing it to rest on an edge 68 defined in the back wall 54 and the discharge passage wall 57. Sealing material such as silicone is positioned between the rim 66 and the edge 68 in order to provide a sealing action between the case 66 and the edge 68.

The air guiding case 61 extends from the fan 60 into the air duct 46. The guiding fins 62 direct the flow of air, therefore, limiting air turbulence and increasing the efficiency of the blower assembly 44.

Power to the electric motor 58 is provided through an extension cord 74. The extension cord 74 originating from a power supply, not shown, extends through a first aperture 76 in the floor 18 into an outlet 78 in the bottom of the body 12 leading to the extesion cord conduit 48 from which it exits through a sealing ring 80. The sealing ring 80 closes the passage 48 adjacent the air chamber 42.

One of the main features of the present invention is the extension cord conduit 48 which consists of a substantially upstanding passage which is self-contained, distinct from the substantially upstanding air duct 46 but longitudinally adjacent the latter. The conduit or channel 48 preferably extends upwardly inside the back wall 54 and fittingly surrounds the extension cord 74.

Since the extension cord 74 is not exposed to the air in the air duct 46 nor to water, the ventilating system meets safety standards which require that electrical systems be fully enclosed when operated inside a bathroom.

Another feature of the present invention is its ability to use a conventional drain pipe 20.

The installation therefore only necessitates the drilling of the aperture 76 in the floor 18 allowing passage of the extension cord 74.

The manner in which the present ventilated bowl is installed only requires that a predetermined length of extension cord 74 be pulled up through the aperture 76. Such predetermined length is introduced through the outlet 78 and slidden in the passage 48 while the body 12 is vertically lowered in the collecting line 20 in the usual manner.

I claim:

1. A self ventilated toilet adapted to be mounted on a floor of a bathroom, the floor being provided with a first perforation connected to a sewage connecting line and a second perforation for allowing an electrical wire to extend through said floor, said toilet comprising:

a water tank adapted to contain water;

a bowl chamber partly located below said tank and adapted to receive water from said tank through a water intake chamber and to be flushed through a flushing aperture provided at the bottom of said bowl chamber;

a discharge passage connecting said bowl chamber to said flushing aperture, said discharge passage disposed adjacent said bowl chamber and extending to a first outlet below said bowl chamber for eliminating said flushed water through said first perforation;

a ventilating chamber mounted adjacent said discharge passage away from said bowl chamber below said tank and leading to said first outlet, said ventilating chamber having a protuberant wall portion projecting above said bowl chamber;

at least one ventilating inlet passage upwardly directed inside said toilet from said bowl chamber and extending above said water intake chamber and leading inside said protuberant wall portion to a level higher than the highest level of water in said bowl chamber, said ventilating inlet passage pneumatically linking said bowl chamber with said ventilating chamber, said protuberant wall portion having a flat upper surface for partially sitting said tank, a removable cover through said protuberant wall portion, said cover downwardly extending through a side of said ventilating chamber, the removal of said tank and said cover providing access to said ventilating chamber;

an electrical air suction device disposed across said ventilating chamber between said ventilating inlet passage and said first outlet for circulating air from said ventilating inlet passage to said first outlet, said suction device being located below said water tank.

2. A toilet as recited in claim 1 comprising a water tank for supplying water to the bowl through an opening rearwardly located in said toilet, wherein said ventilating inlet aperture leads to a channel extending to an upper level of said ventilating chamber above said bowl, said channel allowing air to exit at a level higher than said bowl, whereby an overflow of water in said bowl is prevented from flowing into said ventilating chamber.

3. A toilet as recited in claim 1, comprising a conduit for receiving said electrical wire, said electrical wire being adapted to electrically actuate the suction device, said conduit being located in said ventilating chamber and upwardly extending between said suction device and a second outlet below said bowl, said conduit pneumatically shielding said wire from the ventilating chamber, said second outlet adapted to face said second perforation, whereby said electrical wire is adapted to extend through the floor below said bowl and the suction device is adapted to expel air through said sewage connecting line.

4. A toilet as recited in claim 1, wherein said ventilating chamber has generally upstanding side walls, said conduit for receiving said electrical wire being characterized by a passage extending substantially vertically in the body of one of said side walls away from said discharge passage, said conduit adapted to guide upwardly the electrical wire extending through the floor when the toilet is lowered on the floor.

* * * * *